US012421948B2

(12) United States Patent
Song et al.

(10) Patent No.: US 12,421,948 B2
(45) Date of Patent: Sep. 23, 2025

(54) VARIABLE DISPLACEMENT SWASH PLATE TYPE COMPRESSOR

(71) Applicant: Hanon Systems, Daejeon (KR)

(72) Inventors: Se Young Song, Daejeon (KR); Kwang Jin Kim, Daejeon (KR); Ok Hyun Kim, Daejeon (KR); Dong Hyuk Chang, Daejeon (KR); Ki Sang Hong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 185 days.

(21) Appl. No.: 18/249,278

(22) PCT Filed: Sep. 29, 2021

(86) PCT No.: PCT/KR2021/013340
§ 371 (c)(1),
(2) Date: Apr. 17, 2023

(87) PCT Pub. No.: WO2022/080714
PCT Pub. Date: Apr. 21, 2022

(65) Prior Publication Data

US 2023/0392588 A1 Dec. 7, 2023

(30) Foreign Application Priority Data

Oct. 16, 2020 (KR) ..... 10-2020-0134456

(51) Int. Cl.
*F04B 27/10* (2006.01)
*F04B 27/18* (2006.01)

(52) U.S. Cl.
CPC ..... *F04B 27/109* (2013.01); *F04B 27/1063* (2013.01); *F04B 27/1081* (2013.01); *F04B 27/18* (2013.01); *F04B 27/1054* (2013.01)

(58) Field of Classification Search
CPC ..... F04B 27/109; F04B 27/1063; F04B 27/1081; F04B 27/18; F04B 27/1054; F04B 27/0895; F04B 27/1045; F04B 2027/1827
See application file for complete search history.

(56) References Cited

U.S. PATENT DOCUMENTS

2007/0081905 A1* 4/2007 Takahashi ..... F04B 27/109 417/269

FOREIGN PATENT DOCUMENTS

| | | | |
|---|---|---|---|
| JP | H10227281 | A | 8/1998 |
| JP | H11125179 | A | 5/1999 |
| JP | 2017145827 | A | 8/2017 |
| KR | 1020020092674 | A | 6/2001 |
| KR | 20020092674 | A | 12/2002 |
| KR | 20070064954 | A | 6/2007 |
| KR | 102007064954 | A | 6/2007 |
| KR | 100779067 | B1 * | 11/2007 |
| KR | 20180028303 | A | 3/2018 |

* cited by examiner

*Primary Examiner* — Charles G Freay
(74) *Attorney, Agent, or Firm* — Shumaker, Loop & Kendrick, LLP; James D. Miller

(57) ABSTRACT

A variable displacement swash plate type compressor which smoothly supplies oil contained in a refrigerant inside a crank-case to a drive shaft seal region of a front housing, and thus the frictional heat temperature between the drive shaft and a sealing member can be reduced, leakage of refrigerant and pressure is prevented, and durability can be improved.

16 Claims, 8 Drawing Sheets

VARIABLE DISPLACEMENT SWASH PLATE TYPE COMPRESSOR

CROSS REFERENCE TO RELATED PATENT APPLICATIONS

This is a U.S. national phase patent application of PCT/KR2021/013340 filed Sep. 29, 2021 which claims the benefit of and priority to Korea Patent Application No. 10-2020-0134456 filed on Oct. 16, 2020, the entire contents of each of which are incorporated herein by reference.

TECHNICAL FIELD

The present invention relates to a variable displacement swash plate type compressor, and more particularly, to a variable displacement swash plate type compressor capable of smoothly supplying oil contained in a refrigerant in a crank-case to the seal region of the drive shaft of the front housing to reduce the temperature of frictional heat between the drive shaft and the sealing member, prevent leakage of the refrigerant and pressure, and improve durability.

BACKGROUND ART

A compressor constituting an air conditioner for vehicles is a device that receives power from a power source selectively by the intermittent actuation of an electronic clutch, sucks refrigerant gas from the evaporator into the interior, compresses the refrigerant gas by the linear reciprocating motion of a piston, and then discharges the refrigerant gas to a condenser. These compressors may be classified into various types according to compression methods and structures, and a variable displacement type compressor capable of changing a compression volume is also widely used among these compressors.

A conventional variable displacement swash plate type compressor will be described with reference to FIGS. 1 and 2.

A variable displacement swash plate type compressor may include a cylinder block 10 with a plurality of cylinder bores 11 concentrically formed in an axial direction, a front housing 20 mounted on the front side of the cylinder block 10 and including a crank-case 21 formed therein, a rear housing 30 mounted on the rear side of the cylinder block 10 and including a suction chamber 31 and a discharge chamber 32 formed therein, a plurality of pistons 40 respectively inserted into the cylinder bores 11 of the cylinder block 10 to reciprocate and having bridges 41 formed at the rear ends thereof, a drive shaft 50 having one end rotatably passing through the front housing 20 and a rear end inserted into the center of the cylinder block 10 to be rotatably installed, a rotor 60 coupled to the drive shaft 50 inside the crank-case 21 to rotate together with the drive shaft 50, a swash plate 70 rotatably installed in such a way that a sleeve 65 is slidably coupled to the periphery of the drive shaft 50 and fluidically connected to a hinge arm 61 of the rotor 60 such that an inclination angle thereof is adjustable with respect to the drive shaft 50 when the swash plate 70 is rotating along with the rotor 60 while an edge of the swash plate 70 is rotatably coupled to the insertion space of the bridge 41 of the piston 40 via a shoe 45 disposed in the insertion space, and a valve unit 80 installed between the cylinder block 10 and the rear housing 30 to suck refrigerant from the suction chamber 31 into the cylinder bore 11 during the suction stroke and discharge compressed refrigerant from the cylinder bore 11 to the discharge chamber 32 during the compression stroke.

A slot 62 may be formed in the hinge arm 61 of the rotor 60, and a connecting hinge arm 73 protruding from both sides of the hinge arm 61 and having a hinge pin 74 to be fluidically coupled to the slot 62 of the hinge arm 61 may be formed in a hub 71 of the swash plate 70 facing the hinge arm 61 of the rotor 60, the connecting hinge arm 73. In addition, the rotor 60 is rotatably supported by a thrust bearing 22 installed on an inner wall surface of the front housing 20.

In this case, the inclination angle of the swash plate 70 with respect to the drive shaft 50 is adjusted according to a change in the pressure in the crank-case 21 through a control valve 90 installed in the rear housing 30.

As mentioned above, in the variable displacement swash plate type compressor, the plurality of pistons 40 concentrically arranged on the cylinder block 10 sequentially reciprocate due to the rotation of the swash plate 70, thus resulting in the suction, compression and discharge of the refrigerant. In addition, the inclination angle of the swash plate 70 is adjusted according to a differential pressure between the pressure in the crank-case 21 and the suction pressure in the cylinder bore 11, so that the discharged capacity of the compressor is changed.

On the other hand, the front housing 20 may be provided with a drive shaft seal region 25 to seal between the front housing 20 and the drive shaft 50 to prevent leakage of refrigerant and pressure. The drive shaft seal region 25 is provided with a sealing member 26 configured to seal between the front housing 20 and the drive shaft 50 and a radial bearing 27 installed on one side thereof to rotatably support the drive shaft 50.

In this case, the wear of the sealing member 26 is severely caused due to an increase in the temperature of the frictional heat caused by the friction between the drive shaft 50 and the sealing member 26 during the rotation of the drive shaft 50 in the case of long-term use, resulting in a leak of refrigerant and pressure.

Therefore, in the prior art, oil contained in the refrigerant in the crank-case 21 is supplied to the drive shaft seal region 25 to lower the temperature of the frictional heat and form an oil film, thus preventing leakage. That is, as shown in FIG. 2, an oil supply path 28 is formed in the front housing 20, and the oil hitting against the inner wall surface of the front housing 20 in the case of rotation of a drive portion (the rotor, the swash plate, and the drive shaft) is supplied to the drive shaft seal region 25.

However, the oil supply path 28 is almost closed by the thrust bearing 22 interposed between the inner wall surface of the front housing 20 and the rotor 60, so that oil supply is not smoothly performed, causing many problems in lubricating the frictional force between the drive shaft 50 and the sealing member 26.

As described above, if the oil supply is not performed smoothly, the temperature of the frictional heat rises as described above, resulting in severe wear of the sealing member 26. Accordingly, the leakage of the refrigerant and pressure is caused, resulting in many problems with durability, such as malfunction of the compressor.

SUMMARY

An object of the present invention is to provide a variable displacement swash plate type compressor capable of smoothly supplying oil contained in a refrigerant in a crank-case to the seal region of the drive shaft of the front housing to reduce the temperature of frictional heat between the drive shaft and the sealing member, prevent leakage of the refrigerant and pressure, and improve durability.

Technical problems to be solved by the present invention are not limited to the above-mentioned technical problems, and other technical problems, which are not mentioned above, may be clearly understood from the following descriptions by those skilled in the art to which the present invention pertains.

A variable displacement swash plate type compressor includes a front housing and a rear housing; a cylinder block coupled between the front housing and the rear housing; a drive shaft rotatably installed in the front housing and the cylinder block; a rotor coupled to the drive shaft to rotate with the drive shaft; a swash plate slidably coupled to the rotor and installed on the drive shaft such that an inclination angle thereof is adjustable; a sealing member installed between the drive shaft and the front housing to seal between them; a plurality of flow grooves formed in an inner wall surface of the front housing, oil flowing through the plurality of flow grooves; a connection groove formed in the inner wall surface of the front housing and connecting the plurality of flow grooves; at least one or more oil supply holes configured to connect the connection groove and a seal region in which the sealing member is installed to supply the oil to the seal region; and a race disposed on the inner wall of the front housing to cover the connection groove to form an oil chamber in communication with the oil supply hole.

In this way, oil flowing through the groove may be supplied smoothly to the oil supply hole without flowing to another place by covering the connection groove with a race to form an oil chamber in communication with the oil supply hole.

According to an embodiment of the present invention, the race may further cover at least a portion of the flow groove.

According to an embodiment of the present invention, the race may cover at least a portion of the oil supply hole.

According to an embodiment of the present invention, the at least one or more oil supply holes may be formed in the connection groove.

According to an embodiment of the present invention, the plurality of flow grooves may be radially formed in the inner wall surface of the front housing.

According to an embodiment of the present invention, the plurality of flow grooves may be formed in an upper portion of the front housing.

According to an embodiment of the present invention, the connection groove may be formed in the inner wall surface of the front housing in a circumferential direction around an insertion hole into which the drive shaft is inserted.

According to an embodiment of the present invention, the connection groove may be formed in an upper portion of the front housing such that both ends are blocked by boundary portions to prevent flow of oil.

According to an embodiment of the present invention, a width of the connection groove may be formed larger or equal to a diameter of the oil supply hole.

According to an embodiment of the present invention, the number of oil supply holes may be less than the number of flow grooves.

According to an embodiment of the present invention, the at least one or more oil supply holes may connect both ends of the connection groove to the seal region.

In this way, as the oil supply hole is connected to both ends of the connection groove where the oil flow is blocked by the boundary portion, the oil flowing through the groove can be immediately supplied instead of being supplied to the oil supply hole after filling the oil chamber.

According to an embodiment of the present invention, the at least one or more oil supply holes may be formed radially outward from a boss portion protruding from an inner wall surface of the front housing.

According to an embodiment of the present invention, the variable displacement swash plate type compressor may further include a circulation groove formed in the inner wall surface of the front housing to circulate oil, and the circulation groove may be disposed on an opposite side of the connection groove with respect to the boundary portion.

According to an embodiment of the present invention, the circulation groove may be formed in the inner wall surface of the front housing in a circumferential direction around an insertion hole into which the drive shaft is inserted.

According to an embodiment of the present invention, the variable displacement swash plate type compressor may further include an extension groove radially extending from the circulation groove.

In this way, the circulation groove and the extension groove are formed, so that oil is supplied to the race and at the same time, the oil is discharged back to the crank-case to enable circulation.

According to an embodiment of the present invention, a radial bearing configured to support rotatably the drive shaft may be further installed in the seal region.

According to an embodiment of the present invention, the variable displacement swash plate type compressor may further include an oil collecting portion connected to the flow groove radially outward from the flow groove and having a width narrowing toward the flow groove.

According to the present invention, oil flowing through the groove may be smoothly supplied to the oil supply holes without flowing to another place by covering the flow groove, the connection groove, and the oil supply holes with the race to form an oil chamber.

In addition, as the oil supply holes are connected to both ends of the connection groove where the oil flow is blocked by the boundary portion, oil flowing through the groove can be supplied to the oil supply holes immediately rather than being supplied to the oil supply holes after the oil has been filled in the oil chamber.

As a result, a large amount of oil is smoothly supplied to the seal region of the drive shaft of the front housing, so that the temperature of frictional heat between the drive shaft and the sealing member can be lowered, thus preventing leakage of refrigerant and pressure and improving durability.

In addition, by forming the circulation groove and the extension groove for circulating oil, oil can be supplied to the race and at the same time, the oil can be discharged back to the crank-case, thus enabling circulation of oil.

In addition, the processing time and cost can be reduced by forming less oil supply holes that requires separate drilling processing as the number of oil supply holes is formed less than the number of flow grooves.

The effects of the present invention are not limited to the above-mentioned effects, and it should be understood that the effects of the present invention include all effects that may be derived from the detailed description of the present invention and the drawings.

DESCRIPTION OF AN EMBODIMENT

Figure 1:
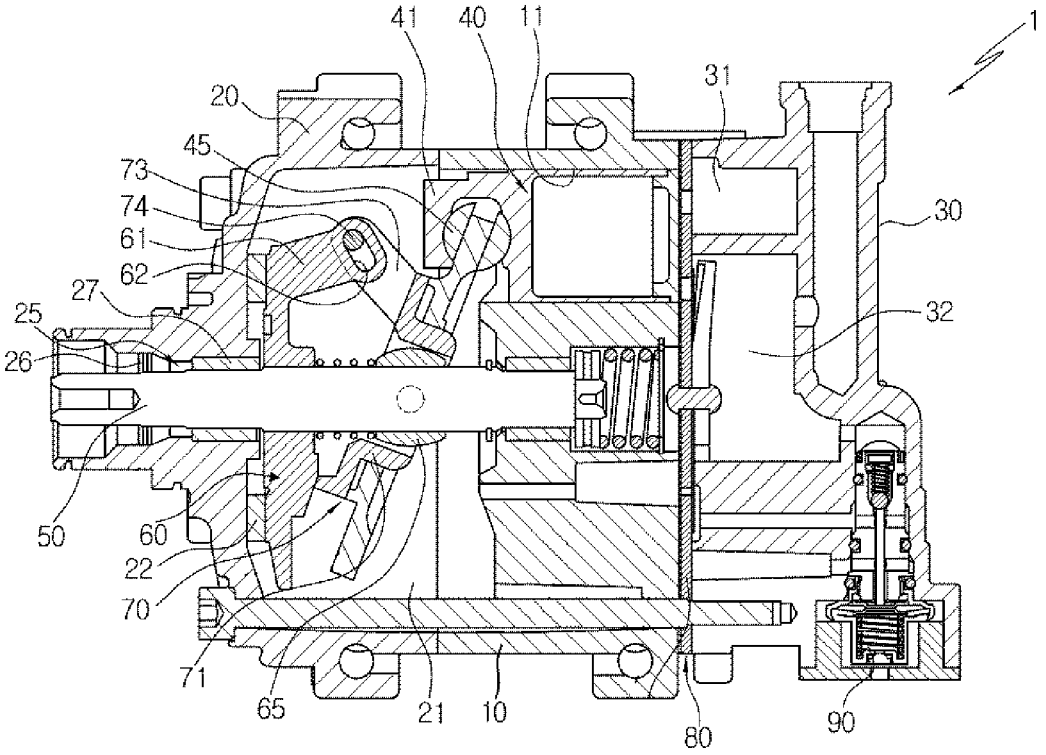
FIG. 1 PRIOR ART
FIG. 1 is a cross-sectional view showing a conventional variable displacement swash plate type compressor.
Figure 2:
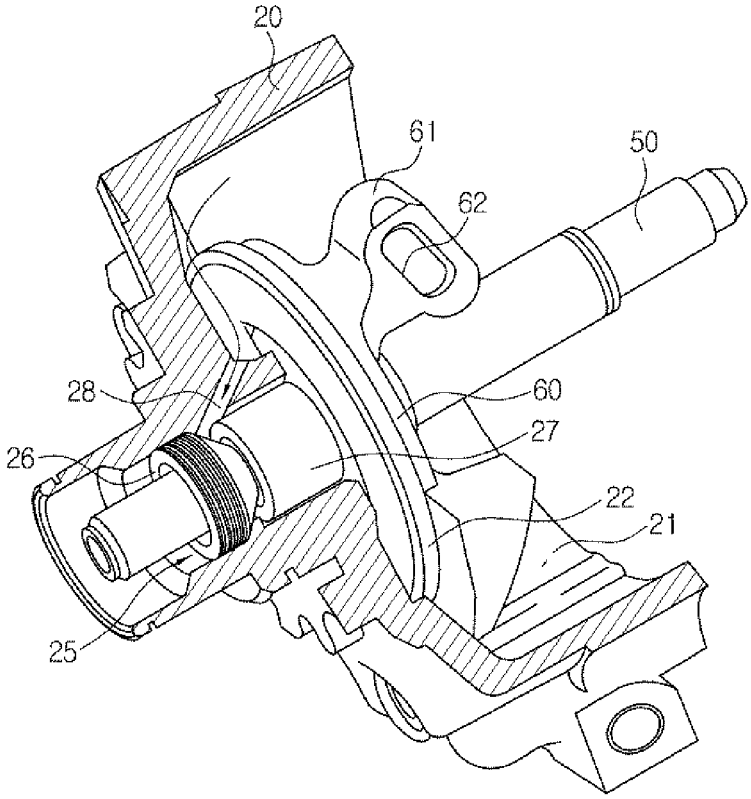
FIG. 2 PRIOR ART
FIG. 2 is a perspective view showing a front housing taken in an oblique direction in FIG. 1.

Hereinafter, exemplary embodiments of a scroll compressor according to the present invention will be described with reference to the accompanying drawings.

In addition, the terms used below are defined considering the functions in the present invention and may vary depending on the intention of a user or an operator or a usual practice. The following embodiments are not intended to limit the protection scope of the present invention but just exemplary constituent elements disclosed claims in the present invention.

A part irrelevant to the description will be omitted to clearly describe the present invention, and the same or similar constituent elements will be designated by the same reference numerals throughout the specification. Throughout the specification, unless explicitly described to the contrary, the word "comprise/include" and variations such as "comprises/includes" or "comprising/including" will be understood to imply the inclusion of stated elements, not the exclusion of any other elements.

Figure 3:
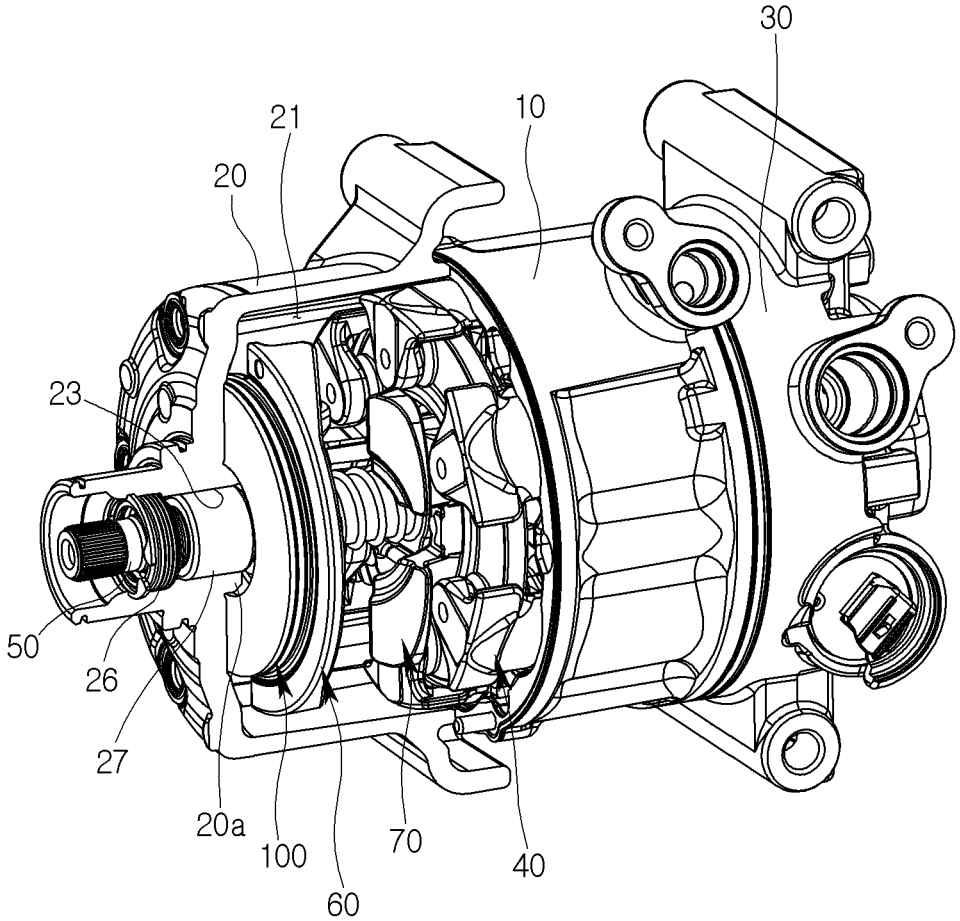
FIG. 3 is a perspective view showing a state in which a front housing is vertically cut in a variable displacement swash plate type compressor according to an embodiment of the present invention.
Figure 4:
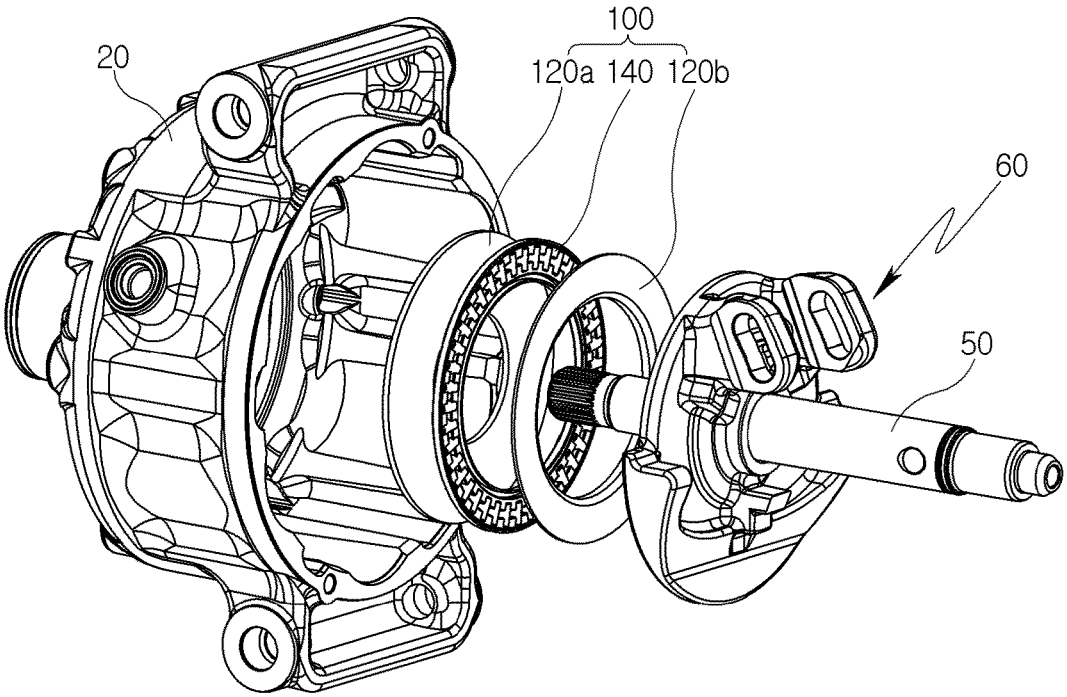
FIG. 4 is a perspective view showing the front housing of FIG. 3 and parts disposed therein, which are separated.

First, a variable displacement swash plate type compressor according to an embodiment of the present invention will be described with reference to FIGS. 3 and 4. In addition, the same reference numerals are assigned to the same parts as in the prior art for description.

A variable displacement swash plate type compressor according to an embodiment of the present invention may include a cylinder block 10 in which a plurality of cylinder bores 11 are concentrically formed in an axial direction, and a front housing 20 defining a crank-case 21 in the cylinder block 10 may be mounted on the front side of the cylinder block 10, and a rear housing 30 defining a suction chamber 31 and a discharge chamber 32 are mounted on the rear side of the cylinder block 10.

In each of the cylinder bores 11 of the cylinder block 10, a plurality of pistons 40 each having a bridge 41 formed at the rear end thereof may be inserted and installed to reciprocate.

In addition, a drive shaft 50 having one end rotatably passing through the front housing 20 and a rear end inserted into the center of the cylinder block 10 to be rotatably supported may be installed in the cylinder block 10. Here, the drive shaft 50 may be rotatably supported by the radial bearing 27.

In addition, a rotor 60 coupled to the drive shaft 50 to rotate together with the drive shaft 50 may be installed inside the crank-case 21. The rotor 60 may be rotatably supported by a thrust bearing member 100 installed on the inner wall surface of the front housing 20. As shown in FIG. 4, the thrust bearing member 100 may include a pair of races 120*a* and 120*b* and a thrust bearing 140 disposed between the pair of races 120*a* and 120*b*. The thrust bearing 140 may be implemented with a needle roller bearing including a plurality of rollers radially arranged.

In addition, a swash plate 70 may be rotatably installed on a sleeve 65 slidably coupled to the drive shaft 50 inside the crank-case 21 and be fluidically connected to a hinge arm 61 of the rotor such that an inclination angle thereof is adjustable with respect to the drive shaft 50 when the swash plate 70 is rotating along with the rotor 60 while an edge of the swash plate 70 is rotatably coupled to the insertion space of the bridge 41 of the piston 40 via a shoe 45 disposed in the insertion space.

A slot 62 may be formed in the hinge arm 61 of the rotor 60, and a connecting hinge arm 73 protruding from both sides of the hinge arm 61 and having a hinge pin 74 to be fluidically coupled to the slot 62 of the hinge arm 61 may be formed in a hub 71 of the swash plate 70 facing the hinge arm 61 of the rotor 60, the connecting hinge arm 73. Accordingly, when there is a change in the inclination angle of the swash plate 70, the hinge pin 74 may support the inclination motion of the swash plate 70 while sliding along the slot 62.

Meanwhile, a valve unit 80 for sucking refrigerant into the cylinder bore 11 from the suction chamber 31 during the suction stroke of the piston 40 and discharging compressed refrigerant to the discharge chamber 32 from the cylinder bore 11 during the compression stroke of the piston may be installed between the cylinder block 10 and the rear housing 30.

In addition, a control valve 90 may be installed in the rear housing 30 to operatively communicate the discharge chamber 32 and the crank-case 21 so that the inclination angle of the swash plate 70 is adjusted by changing the differential pressure between the refrigerant suction pressure in the cylinder bore 11 and the gas pressure in the crank-case 21.

In addition, the front housing 20 may be provided with a drive shaft seal region 25 to seal between the front housing 20 and the drive shaft 50 to prevent leakage of refrigerant and pressure. The seal region 25 is provided with a sealing member 26 installed between the front housing 20 and the drive shaft 50 to seal between the front housing 20 and the drive shaft 50. The radial bearing 27 may be installed on one side of the sealing member 26.

Figure 5:
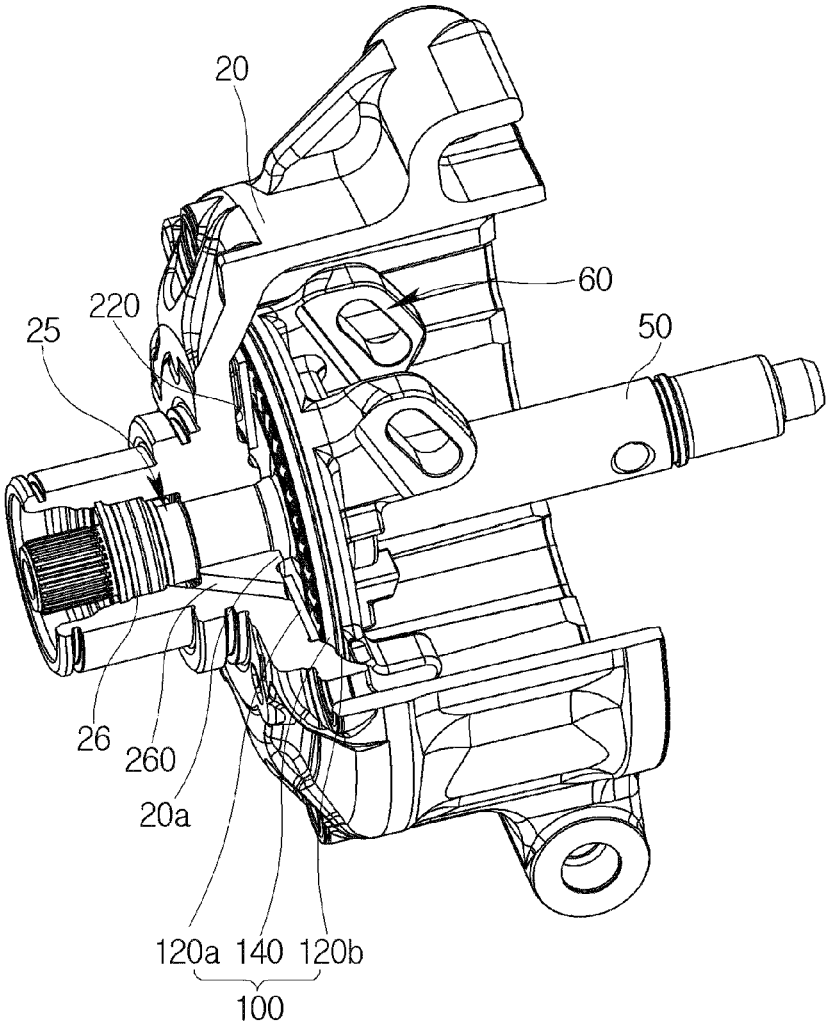
FIG. 5 is a perspective view showing a state in which a front housing and a race are cut at a certain angle in a coupled state of FIG. 4.
Figure 6:
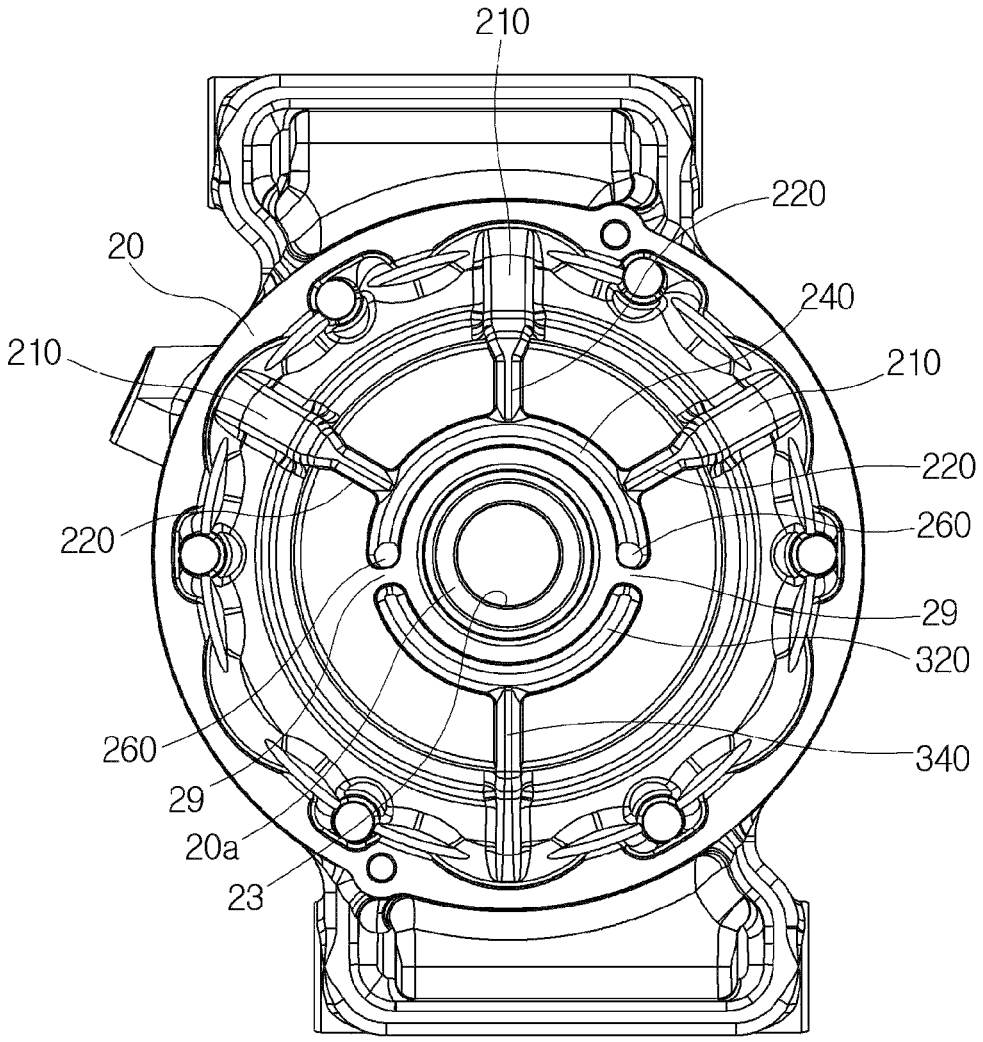
FIG. 6 is a rear view of the front housing of FIG. 4.
Figure 7:
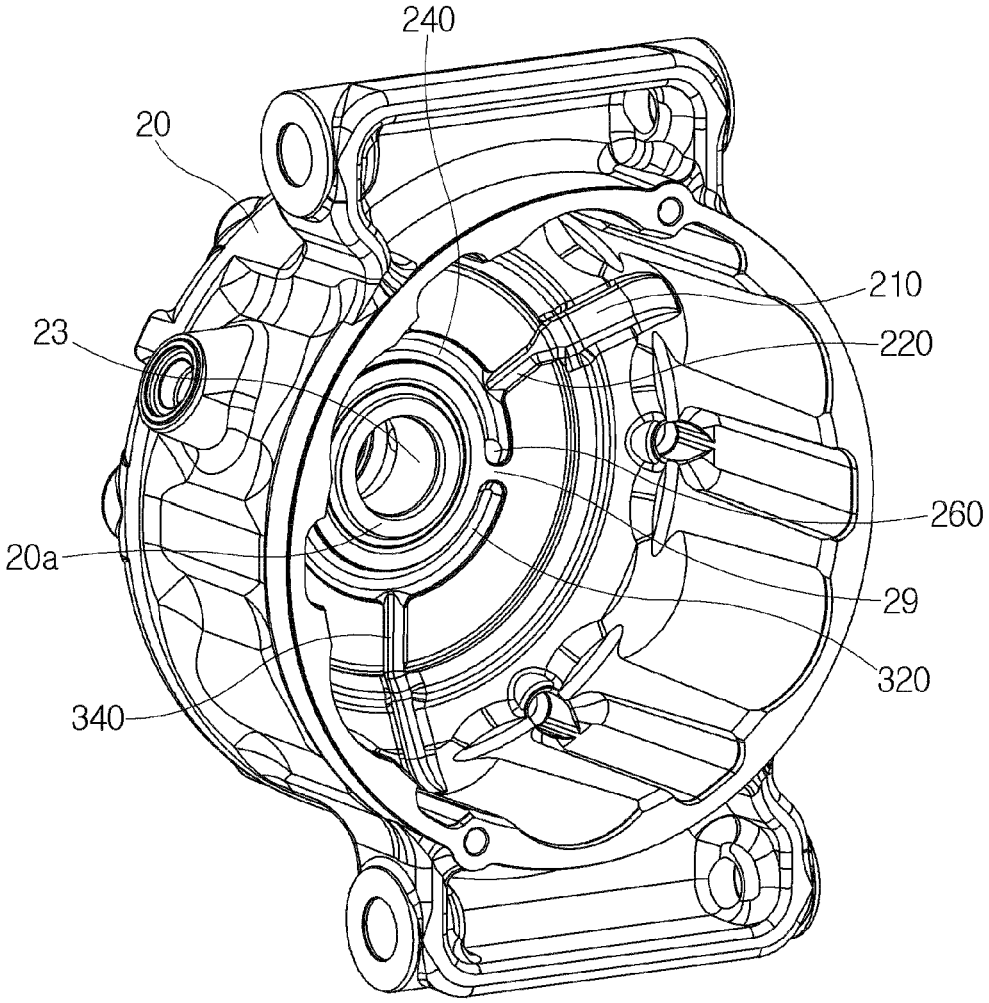
FIG. 7 is a perspective view of FIG. 6.

Hereinafter, a configuration for supplying oil contained in the refrigerant in the crank-case 21 to the seal region 25 will be described in detail with reference to FIGS. 5 to 7.

To this end, the present invention may include a plurality of flow grooves 220 formed on the inner wall surface of the front housing 20 to enable oil to flow therethough, a connection groove 240 formed on the inner wall surface of the front housing 20 to connect the plurality of flow grooves 220, and at least one oil supply hole 260 configured to connect the connection groove 240 and the seal region 25 where the sealing member 26 is installed to supply oil to the seal region 25. The inner wall surface of the front housing 20 is a wall surface disposed to face the rotor 60 in the front housing 20.

The plurality of flow grooves 220 are radially formed on the inner wall surface of the front housing 20. In addition, the plurality of flow grooves 220 are preferably formed in the upper portion of the front housing 20 although not limited thereto. Accordingly, oil hitting the inner wall surface of the front housing 20 while the rotor 60 is rotating may smoothly flow to the connection groove 240 along the plurality of flow grooves 220 by its own weight.

Specifically, most of the oil exists in a liquid state and is collected on the bottom surface of the crank-case 21 by its own weight before the compressor operates. When the compressor operates, the rotor 60, the swash plate 70, and the like rotate, so that the rotating bodies are smeared by oil and the oil is sprayed in all directions by receiving the centrifugal force, thereby resulting in a lot of oil in the radial portion rather than the central portion with the center of the drive shaft 50. In this case, as the plurality of flow grooves 220 are radially formed in the upper portion of the front housing 20 as described above, oil in a liquid state attached to the inner wall surface of the front housing 20 flow down by its own weight from the upper portion to be smoothly supplied through the flow grooves 220.

In this case, an oil collecting portion 210 formed in the radially outer side of each of the flow grooves 220 and connected to the flow groove 220 may be further provided, the oil collecting portion 210 having a width narrowing toward the flow groove 220. The oil collecting portion 210 may be formed to have a larger width than the flow groove 220 and narrow toward the flow groove 220, so that oil, sprayed in the radial direction of the front housing 20 due to rotation of the rotor 60, flows down along the inner wall surface of the front housing 20 to be collected and smoothly suppled to the flow grooves 220.

In addition, according to an embodiment, the plurality of flow grooves 220 may be formed inclined in the same direction as the rotation direction of the rotor 60 to enable a larger amount of oil to flow through the flow grooves as the rotor 60 rotates.

In the present embodiment, three flow grooves 220 are radially formed in an upper portion of the front housing 20.

The connection grooves 240 are formed on the inner wall surface of the front housing 20 in a circumferential direction around the insertion hole 23 into which the driving shaft 50 is inserted. The connection groove 240 may be formed in an upper portion of the front housing 20 such that both ends are blocked by boundary portions 29 to prevent the flow of oil. That is, the both ends of the connection groove 240 through which oil flows by its own weight are blocked by the boundary portions 29. The boundary portions 29 may correspond to the inner wall surface of the front housing 20 that is not grooved.

To this end, in the present embodiment, the connection groove 240 may be formed in a semicircular shape in the upper portion of the front housing 20 rather than formed in a circular shape communicating in the circumferential direction. However, the present invention is not limited thereto, and the connection groove 240 may be formed shorter than a semicircle, of course.

In this case, the one or more oil supply holes 260 are formed in the connection groove 240 and connect both ends of the connection groove 240 and the seal region 25. Specifically, in the present embodiment, two oil supply holes 260 are formed, and each of two oil supply holes 260 may connect both ends of the connection groove 240 blocked by the boundary portion 29 to the seal region 25.

While the oil supply hole 260 may be formed through a separate drilling process, the flow grooves 220 may be formed at once through die casting. Accordingly, the number of oil supply holes 260 may be less than the number of flow grooves 220, and processing time and cost may be reduced.

In addition, it is preferable that the width of the connection groove 240 is greater than or equal to the diameter of the oil supply hole 260. The reason for this is that a function of supplying oil cannot be smoothly performed when the width of the connection groove is smaller than the diameter of the oil supply hole, In the present invention, the flow groove 220, the connection groove 240, and the oil supply hole 260 are shielded by a race 120*a* of the thrust bearing member. That is, among the races formed in a ring shape, specifically, a pair of races 120*a* and 120*b*, the race 120*a* located close to the inner wall surface of the front housing 20 may be located on the inner wall surface of the front housing 20 and may cover the flow groove 220, the connection groove 240, and the oil supply hole 260 to form a closed oil chamber therebetween.

By forming a closed oil chamber as described above, oil flowing through the flow groove 220 and the connection groove 240 may be stored in the oil chamber without flowing to another place, and may be smoothly supplied to the oil supply hole 260. When the closed oil chamber is not formed, only a part of the oil flowing through the groove may be supplied to the oil supply hole, and the remaining oil may flow toward the rotor 60 that is open, resulting in insufficient supply of oil to the seal region.

Furthermore, in the present invention, oil flow is blocked at both ends of the connection groove 240 by the boundary portions 29, and the oil supply hole 260 connects both ends of the connection groove 240 and the seal region 25, so that oil flowing through the flow groove 220 and the connection groove 240 is supplied immediately rather than being supplied after being filled up to the position of the oil supply hole 260 in the oil chamber.

In this case, when the race 120*a* covers the flow groove 220, the connection groove 240, and the oil supply hole 260 to form an oil chamber, the oil supply hole 260 is preferably formed radially outward from a boss portion 20*a* protruding from the inner wall surface of the front housing 20 so as to secure a sealing section.

In the present embodiment, the race 120*a* covers all of the flow groove 220, the connection groove 240, and the oil supply hole 260 to constitute an oil chamber, but the present invention is not limited thereto. That is, the race may cover only the connection groove, or may cover at least a portion of the flow groove or at least a portion of the oil supply hole in addition to the connection groove to form an oil chamber.

In addition, according to an embodiment of the present invention, a circulation groove 320 and an extension groove 340 formed in the inner wall surface of the front housing 20 to circulate oil may be further included.

The circulation groove 320 may be disposed on the opposite side of the connection groove 240 with respect to the boundary portion 29. Like the connection groove 240, the circulation groove 320 may be formed in the inner wall surface of the front housing 20 in a circumferential direction around the insertion hole 23 into which the drive shaft 50 is inserted.

Specifically, the circulation groove 320 may be formed in the lower portion of the front housing 20 in a substantially semicircular shape to be substantially symmetrical to the connection groove 240, so that leaking oil may be stored between the inner wall surface of the front housing 20 and the race 120*a*.

The extension groove 340 may radially extend from the circulation groove 320. Accordingly, the oil in the circulation groove 320 may flow into the extension groove 340 radially connected toward the lower side by its own weight, and may be discharged to the crank-case 21 again.

As described above, the circulation groove 320 and the extension groove 340 are formed so that oil is supplied to the race 120*a* and at the same time, oil is discharged back to the crank-case 21 to enable oil circulation.

Figure 8:
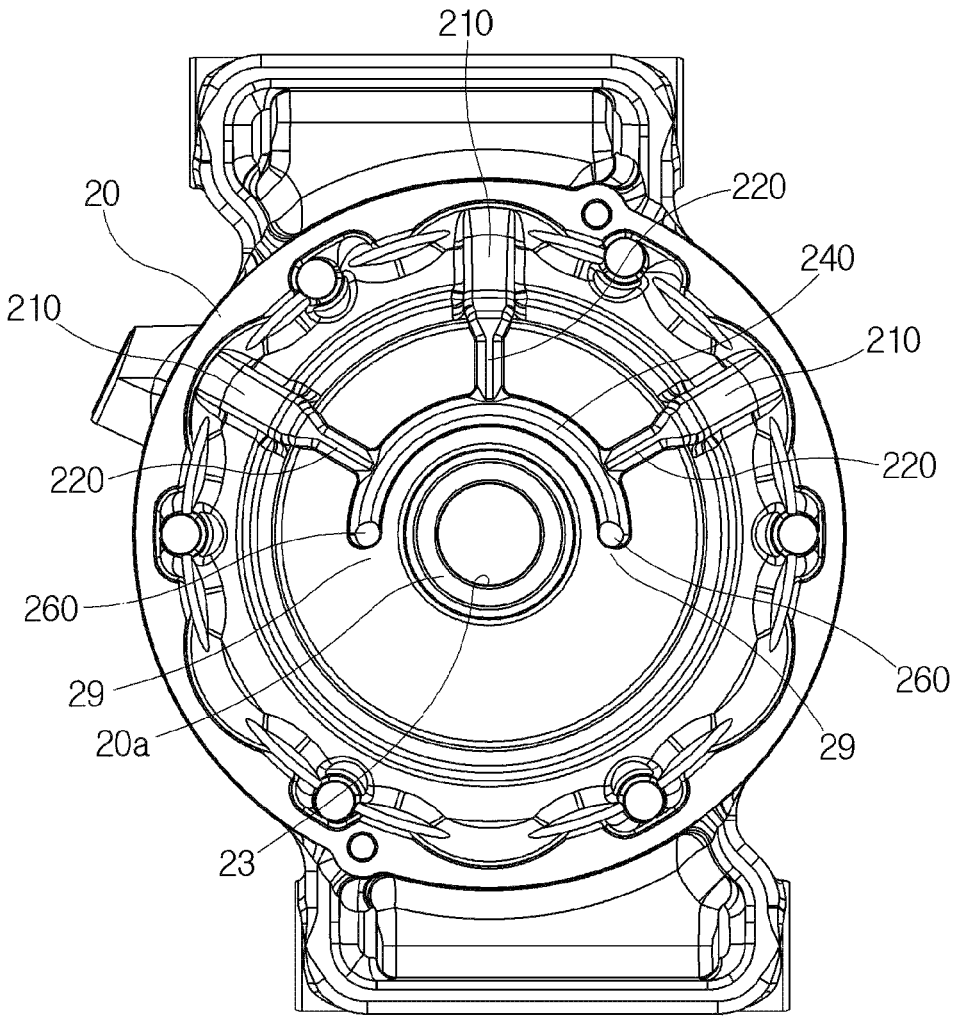
FIG. 8 is a rear view showing a front housing separated from a variable displacement swash plate type compressor according to another embodiment of the present invention.

In FIG. 8, an embodiment is shown in which the circulation groove 320 and the extension groove 340 are omitted, and only the flow groove 220, the connection groove 240, and the oil supply hole 260 are formed in the inner wall surface of the front housing 20.

According to the present invention, since a large amount of oil may be smoothly supplied to the seal region of the drive shaft of the front housing, the temperature of frictional heat between the drive shaft and the sealing member may be lowered, thus preventing leakage of refrigerant and pressure and improving durability.

The present invention is not limited to the specific embodiments and descriptions as described above, various modifications can be made by any person skilled in the art to which the present invention pertains without departing from the subject matter of the present invention as shown and described herein.

The present invention relates to a variable displacement swash plate type compressor, and more particularly, to a variable displacement swash plate type compressor capable of smoothly supplying oil contained in a refrigerant in a crank-case to the seal region of the drive shaft of the front housing to reduce the temperature of frictional heat between the drive shaft and the sealing member, prevent leakage of the refrigerant and pressure, and improve durability.

The invention claimed is:

1. A variable displacement swash plate type compressor comprising:

a front housing and a rear housing;

a cylinder block coupled between the front housing and the rear housing;

a drive shaft rotatably installed in the front housing and the cylinder block;

a rotor coupled to the drive shaft to rotate with the drive shaft;

a swash plate slidably coupled to the rotor and installed on the drive shaft such that an inclination angle thereof is adjustable;

a sealing member installed between the drive shaft and the front housing to seal between the drive shaft and the front housing;

a plurality of flow grooves formed in an inner wall surface of the front housing, an oil flowing through the plurality of flow grooves;

a connection groove formed in the inner wall surface of the front housing and connecting the plurality of flow grooves;

at least one or more oil supply holes configured to connect the connection groove and a seal region in which the sealing member is installed to supply the oil to the seal region; and a race disposed on the inner wall surface of the front housing to cover the connection groove to form an oil chamber in communication with the at least one or more oil supply holes wherein both ends of the connection groove are blocked by boundary portions to prevent flow of the oil, and further comprising:

a circulation groove formed in the inner wall surface of the front housing to circulate the oil, wherein the boundary portions are disposed between the connection groove and the circulation groove, and the oil leaking between the inner wall surface of the front housing and the race is stored in the circulation groove.

2. The variable displacement swash plate type compressor of claim 1, wherein the race covers at least a portion of the plurality of flow grooves.

3. The variable displacement swash plate type compressor of claim 1, wherein the at least one or more oil supply holes are formed in the connection groove.

4. The variable displacement swash plate type compressor of claim 1, wherein the plurality of flow grooves are radially formed in the inner wall surface of the front housing.

5. The variable displacement swash plate type compressor of claim 1, wherein the plurality of flow grooves are formed in an upper portion of the front housing.

6. The variable displacement swash plate type compressor of claim 1, wherein the connection groove is formed in the inner wall surface of the front housing in a circumferential direction around an insertion hole into which the drive shaft is inserted.

7. The variable displacement swash plate type compressor of claim 1, wherein the connection groove is formed in an upper portion of the front housing.

8. The variable displacement swash plate type compressor of claim 3, wherein a width of the connection groove is formed larger or equal to a diameter of the at least one or more oil supply holes.

9. The variable displacement swash plate type compressor of claim 1, wherein a number of the at least one or more oil supply holes is less than the number of the plurality of flow grooves.

10. The variable displacement swash plate type compressor of claim 7, wherein the at least one or more oil supply holes connect both ends of the connection groove to the seal region.

11. The variable displacement swash plate type compressor of claim 1, wherein the at least one or more oil supply holes are formed radially outward from a boss portion protruding from the inner wall surface of the front housing.

12. The variable displacement swash plate type compressor of claim 1, wherein the circulation groove is formed in the inner wall surface of the front housing in a circumferential direction around an insertion hole into which the drive shaft is inserted.

13. The variable displacement swash plate type compressor of claim 12, further comprising:

an extension groove radially extending from the circulation groove.

14. The variable displacement swash plate type compressor of claim 1, wherein a radial bearing configured to support rotatably the drive shaft is further installed in the seal region.

15. The variable displacement swash plate type compressor of claim 4, further comprising:

an oil collecting portion connected to each of the plurality of flow grooves radially outward from the plurality of flow grooves and having a width narrowing toward the plurality of flow grooves.

16. The variable displacement swash plate type compressor of claim 1, wherein the race covers at least a portion of the at least one or more oil supply holes.

* * * * *